US009182163B2

(12) United States Patent
Cho et al.

(10) Patent No.: US 9,182,163 B2
(45) Date of Patent: Nov. 10, 2015

(54) REFRIGERATOR INCLUDING AN ANTI-INTERFERENCE MECHANISM

(71) Applicant: LG ELECTRONICS INC, Seoul (KR)

(72) Inventors: Yeonwoo Cho, Seoul (KR); Yanggyu Kim, Seoul (KR); Younseok Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 150 days.

(21) Appl. No.: 13/914,950

(22) Filed: Jun. 11, 2013

(65) Prior Publication Data

US 2013/0327083 A1 Dec. 12, 2013

(30) Foreign Application Priority Data

Jun. 12, 2012 (KR) ..... 10-2012-0062494

(51) Int. Cl.
*F25D 25/00* (2006.01)
*F25D 11/00* (2006.01)
(Continued)

(52) U.S. Cl.
CPC ..... *F25D 11/00* (2013.01); *F25D 31/007* (2013.01); *F25D 11/02* (2013.01); *F25D 23/025* (2013.01); *F25D 23/12* (2013.01); *F25D 2317/061* (2013.01)

(58) Field of Classification Search
CPC ..... F25D 11/00; F25D 31/007; F25D 23/12; F25D 11/02; F25D 2400/28; F25D 2400/30; F25D 19/30; F25D 19/00; F25D 2317/061; F25D 23/025
USPC ..... 62/407, 466, 404, 411, 412, 441, 314
See application file for complete search history.

(56) References Cited

U.S. PATENT DOCUMENTS 3,915,285 A 10/1975 Lindquist et al.
5,490,713 A * 2/1996 Fukuoka ..... 297/217.3
(Continued)

FOREIGN PATENT DOCUMENTS

CN 2797998 Y 7/2006
CN 1928469 A 3/2007
(Continued)

OTHER PUBLICATIONS

Chinese Office Action dated Apr. 1, 2015 issued in Application No. 201310232706.3 (with English translation).
(Continued)

*Primary Examiner* — Cheryl J Tyler
*Assistant Examiner* — Ana Vazquez
(74) *Attorney, Agent, or Firm* — Ked & Associates, LLP

(57) ABSTRACT

A refrigerator according to an embodiment of the present invention includes: a body having a storage chamber; a door selectively opening or closing the storage chamber; a cooling device including: a case of which a front surface is open and mounted at a side in the storage chamber; an agitating assembly that is swingably disposed in the case; a cover that is rotatably mounted on the case to open or close the front surface of the case; and a driving assembly that is mounted on the case and an underside of the agitating assembly to generates a driving force for swinging the agitating assembly; a refrigeration cycle for producing cold air to be supplied to the storage chamber and the cooling device; and an anti-interference mechanism disposed at the agitating assembly and the case, wherein the anti-interference mechanism is configured to prevent the agitating assembly from hitting against an inner surface of the case while the agitating assembly swings.

5 Claims, 14 Drawing Sheets

(51) Int. Cl.

| | |
|---|---|
| ***F25D 31/00*** | (2006.01) |
| *F25D 11/02* | (2006.01) |
| *F25D 23/02* | (2006.01) |
| *F25D 23/12* | (2006.01) |

(56) References Cited

U.S. PATENT DOCUMENTS

| | | | | |
|---|---|---|---|---|
| 6,082,114 | A * | 7/2000 | Leonoff | 62/3.64 |
| 2003/0209029 | A1 | 11/2003 | Lee et al. | |
| 2004/0144103 | A1* | 7/2004 | Lee et al. | 62/62 |
| 2006/0185372 | A1 | 8/2006 | Hinojosa | |
| 2007/0098432 | A1 | 5/2007 | Mashiki | |
| 2007/0151284 | A1* | 7/2007 | Freesmeier et al. | 62/419 |
| 2008/0134708 | A1 | 6/2008 | Lee et al. | |
| 2009/0064686 | A1 | 3/2009 | Mohebbi et al. | |
| 2009/0095865 | A1 | 4/2009 | Everhart et al. | |
| 2010/0064719 | A1 | 3/2010 | Lee et al. | |
| 2010/0139307 | A1 | 6/2010 | Kulkarni et al. | |
| 2013/0017422 | A1* | 1/2013 | Bae et al. | 429/82 |

FOREIGN PATENT DOCUMENTS

| | | | |
|---|---|---|---|
| CN | 1993589 | A | 7/2007 |
| CN | 101000199 | A | 7/2007 |
| CN | 101071033 | A | 11/2007 |
| CN | 101548143 | A | 9/2009 |
| CN | 101806525 | A | 8/2010 |
| JP | 2004-251560 | A | 9/2004 |
| JP | 2009-222244 | A | 10/2009 |
| KR | 10-2005-0041036 | A | 5/2005 |
| WO | WO 2012/008752 | A2 | 1/2012 |
| WO | WO 2012/008756 | A2 | 1/2012 |

OTHER PUBLICATIONS

Chinese Office Action dated Apr. 24, 2015 issued in Application No. 201310249954.1 (with English translation).

* cited by examiner

REFRIGERATOR INCLUDING AN ANTI-INTERFERENCE MECHANISM

CROSS REFERENCE RELATED APPLICATION

The present application claims the benefits of priority to Korean Patent Application No. 10-2012-0062494 filed on Jun. 12, 2012, which is herein incorporated by reference in its entirety.

THE BACKGROUND

1. The Field

The present invention relates to a refrigerator.

2. Description of the Related Art

In general, refrigerators are appliances that can keep food at low temperatures in the storage spaces therein which are opened or closed by doors. To this end, the refrigerators are configured to be able to keep food in the optimal status by cooling the inside of the storage space, using cold air produced by heat exchange with a refrigerant circulating in a refrigeration cycle.

Recently, refrigerators have been increasing in size and been multi-functioned following the tendency of changes of diet and quality enhancement of the products, and refrigerators having various structures and convenience devices have been being released in consideration of convenience of users.

For example, a demand of users for cooling devices for rapidly cooling drinks or liquors at room temperature in a short time increased, and in order to satisfy the demand, various types of cooling devices that can rapidly cool drinks and liquors at a side therein have been proposed.

In the related art, a cooling device similar to the present invention is disclosed in Korean Paten Publication No. 10-2012-0007617 by the applicant(s).

The cooling device in the published patent has the following problems to solve.

First, a power generator for swing an agitating assembly disposed in the cooling device is positioned close to a rotary shaft of the agitating assembly, such that large torque is required for the swing, which results in a defect that a large amount of power is consumed for the swing.

Second, relatively large torque is required for starting of the agitating assembly in the cooling device, which results in a defect that a large amount of power is consumed.

Third, there is a defect that the agitating assembly hits on the inner walls of the cooing device due to a tolerance generated in manufacturing or the difference in inertia caused by the weight of beverages on the agitating assembly, such that stiffening failure or vibration noise may be generated.

THE SUMMARY

The present invention has been made in an effort to solve the problems and an object of the present invention is to provide a refrigerator equipped with a cooling device that can minimize power consumption for swing an agitating assembly that is a main component of the cooling device.

Another object of the present invention is to provide a refrigerator equipped with a cooling device that can easily achieve starting with minimum power consumption for the starting of an agitating assembly.

Another object of the present invention is to provide a refrigerator equipped with a cooling device that prevents vibration noise due to the agitating assembly hitting on the inner walls of the cooling device, and damage to the agitating assembly in swing, which is caused by the difference in inertial due to the difference in weight of beverages on the agitating assembly.

In order to achieve the objects, a refrigerator according to an embodiment of the present invention includes: a body having a storage chamber; a door selectively opening or closing the storage chamber; a cooling device including: a case of which a front surface is open and mounted at a side in the storage chamber; an agitating assembly that is swingably disposed in the case; a cover that is rotatably mounted on the case to open or close the front surface of the case; and a driving assembly that is mounted on the case and an underside of the agitating assembly to generates a driving force for swinging the agitating assembly; a refrigeration cycle for producing cold air to be supplied to the storage chamber and the cooling device; and an anti-interference mechanism disposed at the agitating assembly and the case, wherein the anti-interference mechanism is configured to prevent the agitating assembly from hitting against an inner surface of the case while the agitating assembly swings.

A refrigerator according to an embodiment of the present invention, which includes the configuration described above, achieves the following effects.

First, there is the effect of being able to minimize power consumption for swinging an agitating assembly that is a main component of a cooling device.

Second, there is the effect that specific power consumption is not needed for starting of an agitating assembly or the power consumption can be minimized.

Third, there is the effect of preventing vibration noise due to the agitating assembly hitting on the inner walls of the cooling device, and damage to the agitating assembly in swinging, which is caused by the difference in inertial due to the difference in weight of liquor on the agitating assembly.

THE DETAILED DESCRIPTION

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Hereinafter, a refrigerator equipped with a cooling device according to an embodiment of the present invention will be described in detail with reference to the accompanying drawings.

Figure 1:
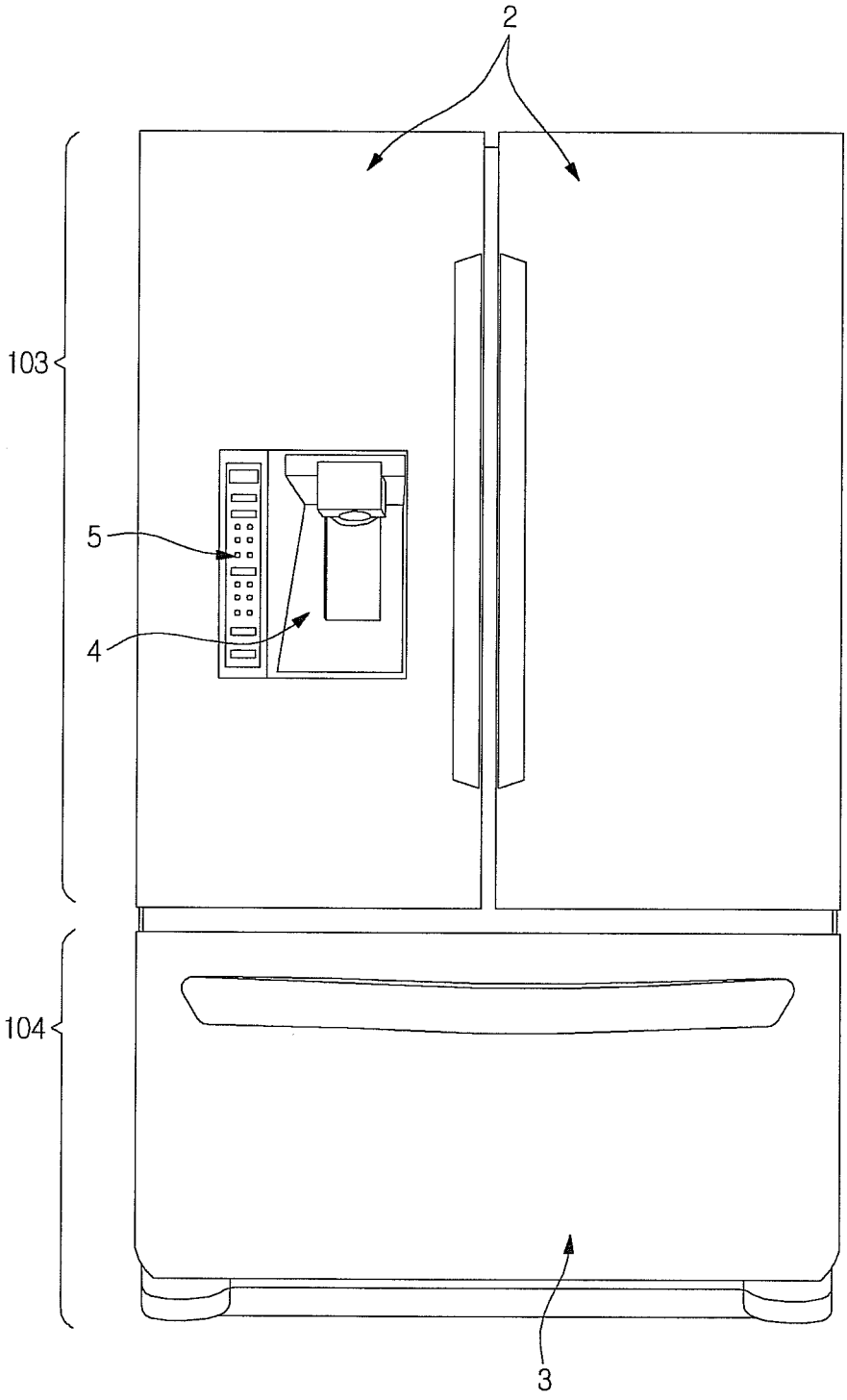
FIG. 1 is a front view of a refrigerator according to an embodiment of the present invention.
Figure 2:
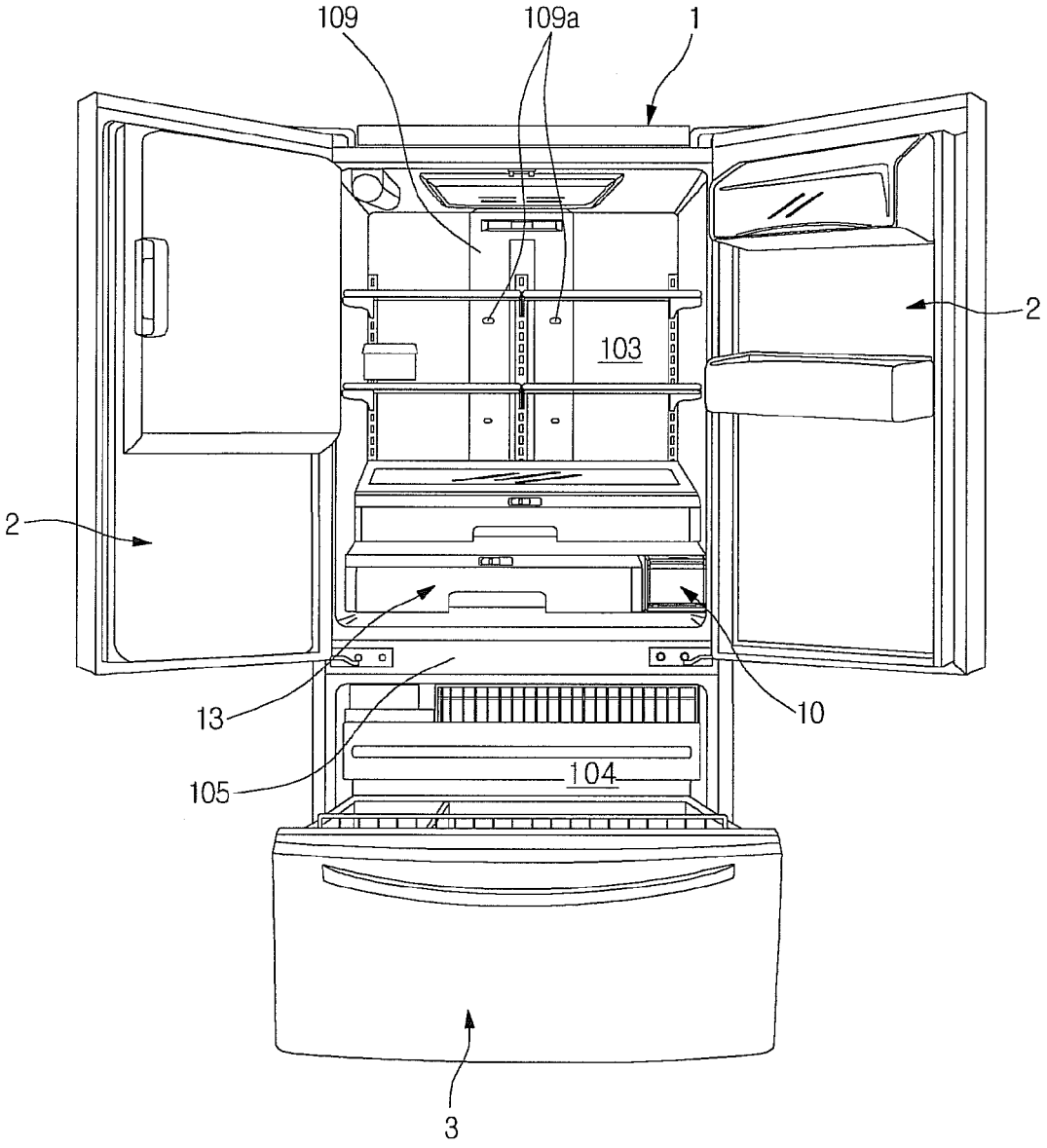
FIG. 2 is a front view of the refrigerator with doors open, according to an embodiment of the present invention.
Figure 3:
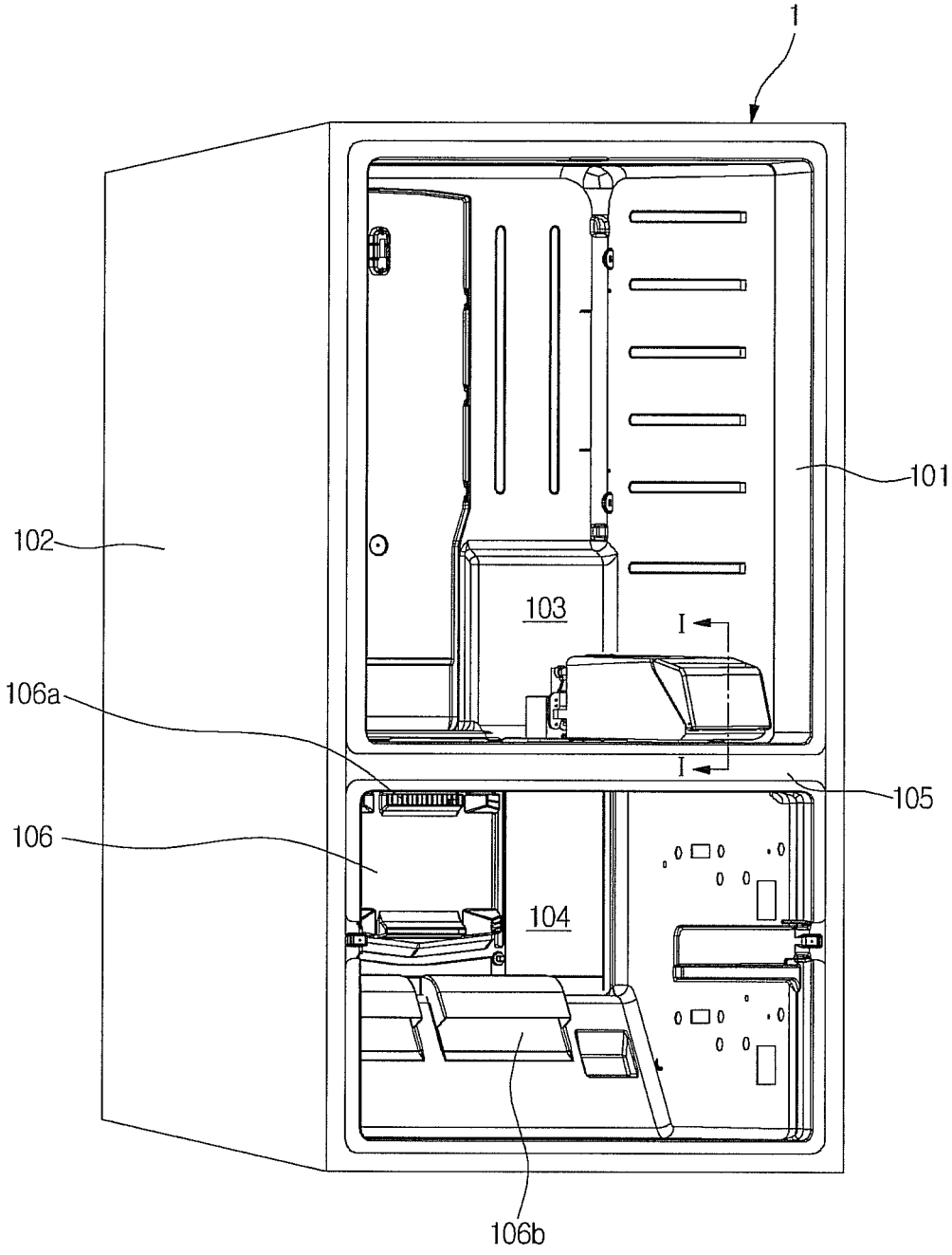
FIG. 3 is a perspective view showing the internal structure of the refrigerator equipped with a cooling device according to an embodiment of the present invention.

FIG. 1 is a front view of a refrigerator according to an embodiment of the present invention, FIG. 2 is a front view of the refrigerator with doors open, according to an embodiment of the present invention, and FIG. 3 is a perspective view showing the internal structure of the refrigerator equipped with a cooling device according to an embodiment of the present invention.

A cooling device according to an embodiment of the present invention can be mounted in a storage space of a refrigerator that keeps food at low temperatures.

In detail, the cooling device can be mounted in a compartment of a refrigerator and perform quick chilling, using the cold air generated by the refrigerator.

The following description exemplifies that the cooling device is mounted in a compartment a refrigerator, as shown in the figures.

Referring to FIGS. 1 to 3, the outer shape of a refrigerator according to an embodiment of the present invention is formed by a cabinet 1 with a refrigerator compartment 103 and a freezer compartment 104 therein and doors opening or closing the refrigerator compartment 103 and the freezer compartment 104.

In detail, the cabinet 1 is formed by an outer case 102 forming the external appearance, an inner case 101 disposed inside the outer case 102 and having a storage space defined therein, and an insulator filled in between the inner case 101 and the outer case 102.

The storage space may include a refrigerator compartment 103 for keeping food cold and a freezer compartment 104 for keeping food frozen. The refrigerator compartment 103 is opened or closed by a pair of storage doors 2 that opens or closes by pivoting and the freezer compartment 104 is opened or closed by a freezer door 3 that slides in or out. The present embodiment exemplifies a bottom freezer type refrigerator in which the storage space is divided up and down by a separation wall 105 and the refrigerator compartment 103 is disposed over the freezer compartment 104.

However, the embodiment of the present invention can be applied, other than the bottom freezer type refrigerator, to a top mount type refrigerator with a freezer compartment over a refrigerator compartment, a side-by-side type refrigerator with a freezer compartment and a refrigerator compartment disposed at both sides, a refrigerator only with a refrigerator compartment, or a freezer only with a freezer compartment.

An evaporation chamber 107 (see FIG. 4) is formed on a rear side in the freezer compartment 104 by an evaporation chamber wall 106 and an evaporator 108 is disposed in the evaporation chamber 107. A cold air discharge port 106*a* through which cold air is discharged into the freezer compartment 104 and a cold air return port 106*b* through which the cold air in the freezer compartment 104 returns to the evaporation chamber 107 may be formed at the evaporation chamber wall 106. Therefore, the cold air in the freezer compartment 104 and the evaporation chamber 107 can continuously cool the freezer compartment 104 while circulating through the cold air discharge port 106*a* and the cold air return port 106*b*.

A refrigerator compartment duct 109 vertically extends on the rear side in the refrigerator compartment 103 and the lower end of the refrigerator compartment 109 communicates with the evaporation chamber 107. Cold air discharge ports 109*a* may be formed through the front of the refrigerator compartment duct 109 and a cold air return port (not shown) may be formed at a side of the top of the separation wall 105. Therefore, the cold air in the refrigerator compartment 103 and the evaporation chamber 107 can continuously cool the refrigerator compartment 103 while circulating through the cold air discharge port 109*a* and the cold air return port.

A cooling device 10 rapidly cooling drinks or liquors can be disposed at any one side on the top of the separation wall 105. The cooling device 10 may be independently mounted on the top of the separation wall 105 or may be combined with a drawer assembly 13 to be mounted on separation wall 105 and then disposed as an assembly on the top of the separation wall 105. The cooling device 10 may fluidly communicate with the evaporation chamber 107 and/or the freezer compartment 104 by channels for connecting them. For example, cold air produced through the evaporation chamber 107 may be supplied to the cooling device 10 so that a drink container 6 (see FIG. 4) in the cooling device 10 is cooled by the cold air supplied to the cooling device 10. The cold air with the temperature increased by heat exchange with the drink container 6 in the cooling device 10 may return to the evaporation chamber 107. The fluid communication may mean that cold air can be circulated by a channel structure such as a duct between the evaporation chamber 107 and the cooling device 10. The drink container 6 used in an embodiment of the present invention is defined as including all types of containers including bottles or cans filled with water, drink, and liquor. The cooling device 10 may be defined as including a chilling compartment defining the space where the drink container 6 is received and/or and a cold air channel connecting the chilling compartment, the freezer compartment 104, and the evaporation chamber 107.

A dispenser 4 that allows ices made by an ice-making chamber 6 or purified water to be taken out from the outside may be disposed on the front of any one of the pair of storage doors 2. The dispenser 4 may include a display unit 5. The display unit 5 may be exposed on the front of the storage door 2 and may be disposed on the other one of the storage doors 2 separately from the dispenser 4.

The display unit 5, which allows operating the refrigerator while displaying the operation status of the refrigerator, may be configured by combination of buttons and a display, which is generally used, or may be configured such that a display that displays information is operated by a touch.

The display unit 5 is configured to display the operation status of the cooling device 10 or control the operation of the cooling device 10. That is, a user can make drink containers rapidly cooled by selecting the operation time or mode of the cooling device 10 as well as turning on or off the cooling device 10 by operating the display unit 5. Further, the display unit can display the operation status of the cooling device 10, and when the cooling device 10 abnormally operates, the display unit can inform the user of the abnormal operation by displaying it.

Figure 4:
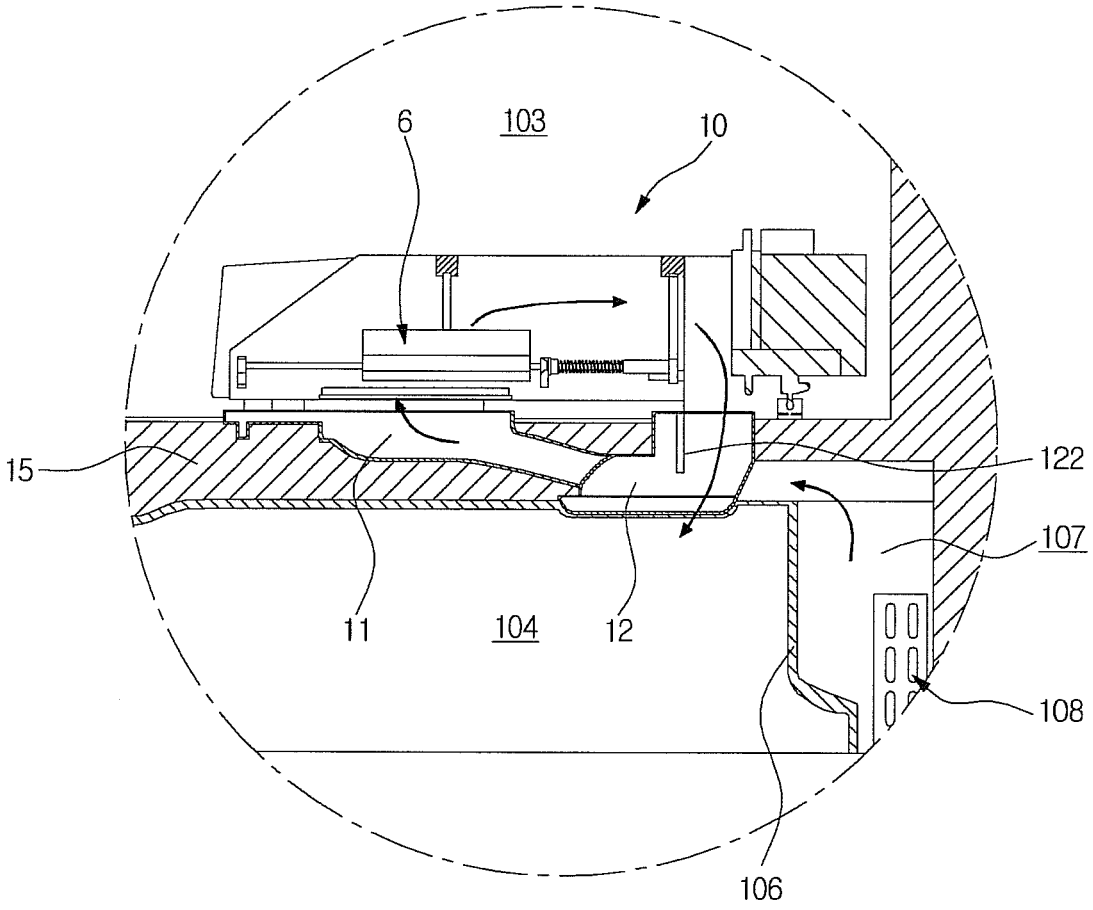
FIG. 4 is a cross-sectional view taken along line I-I of FIG. 3, which shows the configuration of a cold air channel in the cooling device.

FIG. 4 is a cross-sectional view taken along line I-I of FIG. 3, which shows the configuration of a cold air channel in the cooling device.

Referring to FIG. 4, the cooling device 10 may be disposed at a lower corner in the refrigerator compartment 103, on the top of the separation wall 15 in connection with a cold air channel.

In detail, the cold air channel is composed of an intake duct 11 for supplying the cold air in the evaporation chamber 107 to the cooling device 10 and a return duct 12 for discharging the cold air in the cooling device 10 to the evaporation chamber 107. The intake duct 11 and the return duct 12 are disposed in or through the separation wall 15.

In detail, the outlet of the intake duct 11 and the inlet of the return duct 12 may be exposed through the top of the separation wall 15 to be able to communicate with the cooling device 10, when the cooling device 10 is mounted. The inlet of the intake duct 11 is open into the evaporation chamber 107 and the outlet of the return duct 12 is open into the freezer compartment 104. Depending on the way of designing, the outlet of the return duct 12 may also communicate with the evaporation chamber 107.

A damper 122 may be disposed close to the inlet of the return duct 12. The damper 122 allows the cold air in the case 20 to flow to the freezer compartment 104 by opening when the cooling device 10 operates. While the cooling device 10 does not operate, the return duct 12 may prevent cold air from flowing by closing. The damper 122 may be, if necessary, disposed in the intake duct 11 or in each of the intake duct 11 and the return duct 12.

The intake duct 11 and the return duct 12 may be manufactured by injection-molding a plastic material and then disposed in the separation wall 15 and can be combined with the cooling device 10, when the cooling device 10 is seated on the separation wall 15. The intake duct 11 and the return duct 12 may be integrally formed in forming of the separation wall 15, or may not be formed as separate parts, but implemented by forming passages when forming the separation wall 15 such that the cooling device 10 communicates with the freezer compartment 104 and the evaporation chamber 107.

The cold air channel may make the evaporation chamber 107 and the cooling device 10 communicate with each other so that the cold air in the evaporation chamber 107 is supplied to the cooling device 10 and the cold air that has exchanged heat returns to the evaporation chamber 107.

The structure, operation, and function of the cooling device 10 are described hereafter in more detail with reference to the drawings.

Figure 5:
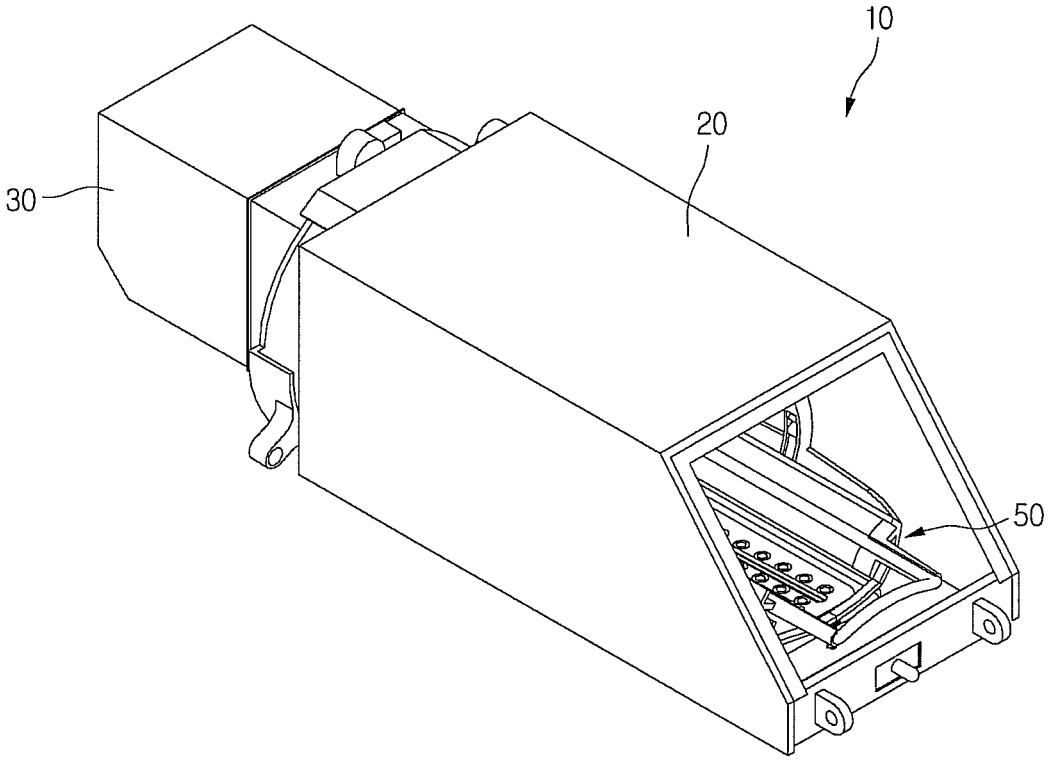
FIG. 5 is a perspective view of a cooling device according to an embodiment of the present invention.
Figure 6:
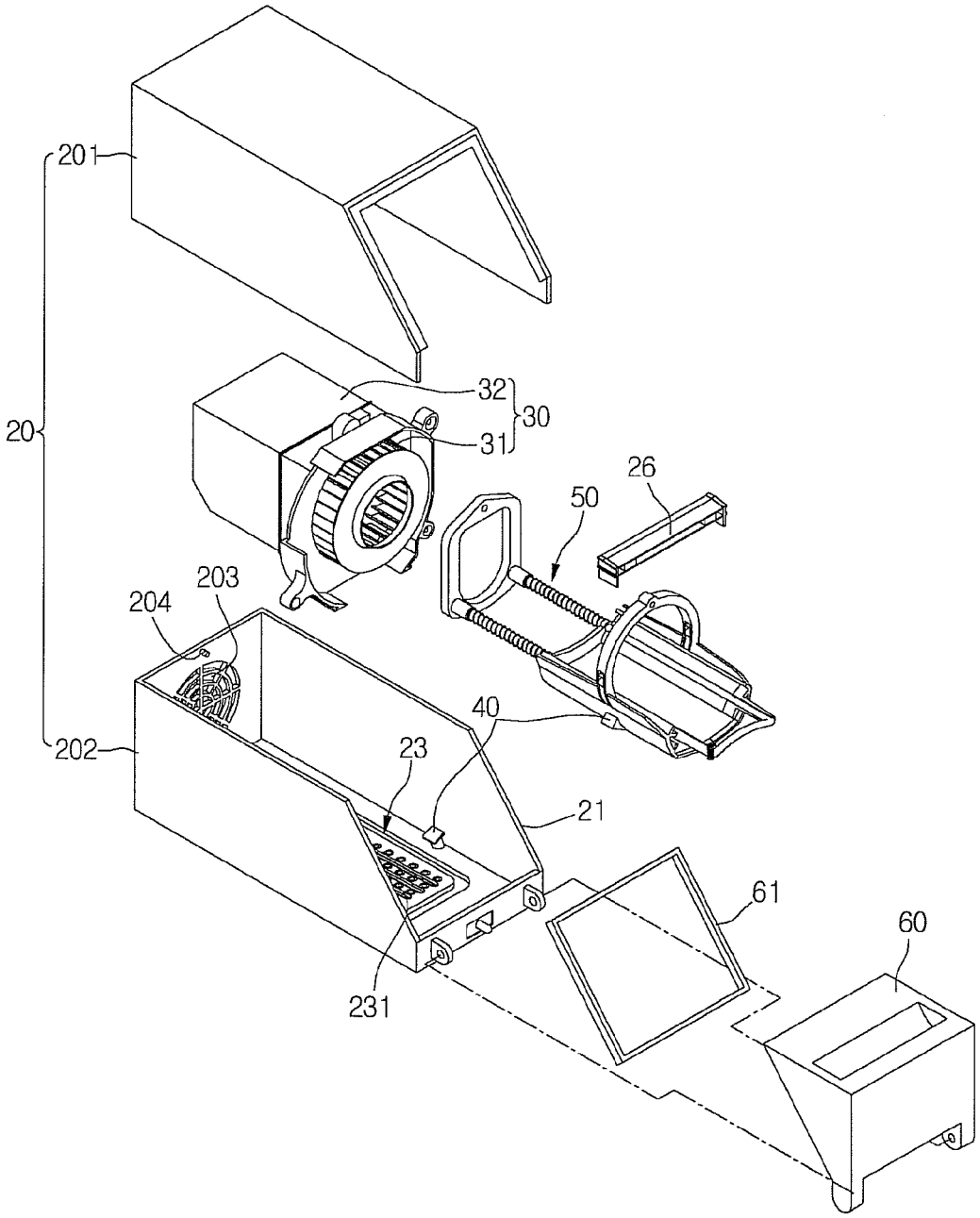
FIG. 6 is an exploded perspective view of the cooling device.

FIG. 5 is a perspective view of a cooling device according to an embodiment of the present invention and FIG. 6 is an exploded perspective view of the cooling device.

Referring to FIGS. 5 and 6, the cooling device 10 according to an embodiment of the present invention includes a case 20 that defines a storage space for the drink container 6 therein, a cover 60 that closes the inlet of the case 20, an agitating assembly 50 that is selectively received in the case 20 and on which the drink container 6 is seated, a fan motor assembly 30 that is mounted in the case 20 and forces cold air to flow, and a driving assembly 40 that is disposed on the underside of the agitating assembly 50 and the bottom of the case 20 and drives the agitating assembly 50.

In detail, the case 20 is open at the front and rear and has a space where the agitating assembly 50 and the drink container 6 can be received. The fan motor assembly 30 is mounted on the rear of the case 20. The fan motor assembly 30 includes a fan 31 that takes cold air in the case 20 and a motor 32 that drives the fan 31.

The case 20 may be composed of an upper case 201 and a lower case 202 combined with the upper case 201. The upper case 201 may cover the lower case 202 while forming the top and the left and right sides of the case 201. The lower case 202 is disposed inside the upper case 201 and forms the rear, the left and right sides, and the bottom of the case 20. A plurality of ribs is formed on the outer side of the lower case 202, and a predetermined space is defined between the upper case 201 and the lower case 202, when the upper and lower cases are combined. Therefore, the sides of the case 20 have a structure that have an air space for thermal insulation and can prevent deformation due to a shock. Obviously, an insulator may be disposed in the space between the upper case 201 and the lower case 202 to insulate the cooing device 10 and the refrigerator compartment 103 from each other. Further, a cold air discharge grill 203 for discharging the cold air introduced by the fan 31 and an agitating assembly supporting portion 204 to which the rear of the agitating assembly 50 swingably connected are formed at the rear side of the lower case 202. The agitating assembly supporting portion 204 may be a hole or a protrusion.

A supporter frame 26 is mounted on the case 20, in detail, on the top of the upper case 201 and a shaft 511 (described below with reference to FIG. 7) which is the center of swing of the agitating assembly 50 is fitted in the supporter frame 26.

An inlet 21 for taking in or out the drink container 6 is formed at the front of the case 20. The inlet 21 protrudes gradually forward as it goes down, that is, is formed at an angle downward. Accordingly, when the cover 60 is open, the exposed area of the drink container 6 increases, such that the drink container 6 can be more easily taken in or out. The inlet 21 is opened or closed by the cover 60. The cover 60 forms the entire external shape of the cooling device and may be at least partially made of a transparent material to show the inside of the case 20.

A gasket 61 for sealing may be disposed around the cover 60 or at the front of the case 20 to prevent leak of cold air between the cover 60 and the case 20. Further, a fixing member that keeps the cover 60 closed, when the cover 60 is closed, may be disposed around the cover 60 or at the front of the case 20. Obviously, the inside of the case 20 is at a negative pressure lower than the atmospheric pressure and the cover 60 can keep closed, when the cooling device 10 is in operation, such that a specific configuration for fixing may not be provided.

A cover fitting portions 212 are formed at the lower end of the inlet 21. The cover fitting portions 212 are fitted in the lower end of the cover 60. Therefore, the cover 60 can open or close the inlet 21 by pivoting about the cover fitting portions 212.

An intake grill 23 is detachably mounted on the bottom in the case 20. In detail, the intake grill 23 is formed at the position corresponding to the outlet of the intake duct 11.

A plurality of air holes 231 may be formed through the bottom of the intake grill 23. In detail, a plurality of air holes 231 having a small diameter is formed through the bottom of the intake grill 23, such that cold air rapidly increases in flow speed, when passing through the outlet of the intake duct 11, that is, the grill 23. Therefore, because the cold air can make jet stream while passing through the air holes 231, the air holes may be defined as jet holes. The air holes 231 are uniformly arranged at regular intervals throughout the intake grill 23.

The upper end of the intake grill 23 bends and extends outward to be locked to the bottom of the case 20, such that it can be detachably mounted on the bottom of the case 20. It should be noted that a locking structure for preventing the intake grill 23 from being separated from the bottom of the case 20 by the introduced air is accordingly provided.

Figure 7:
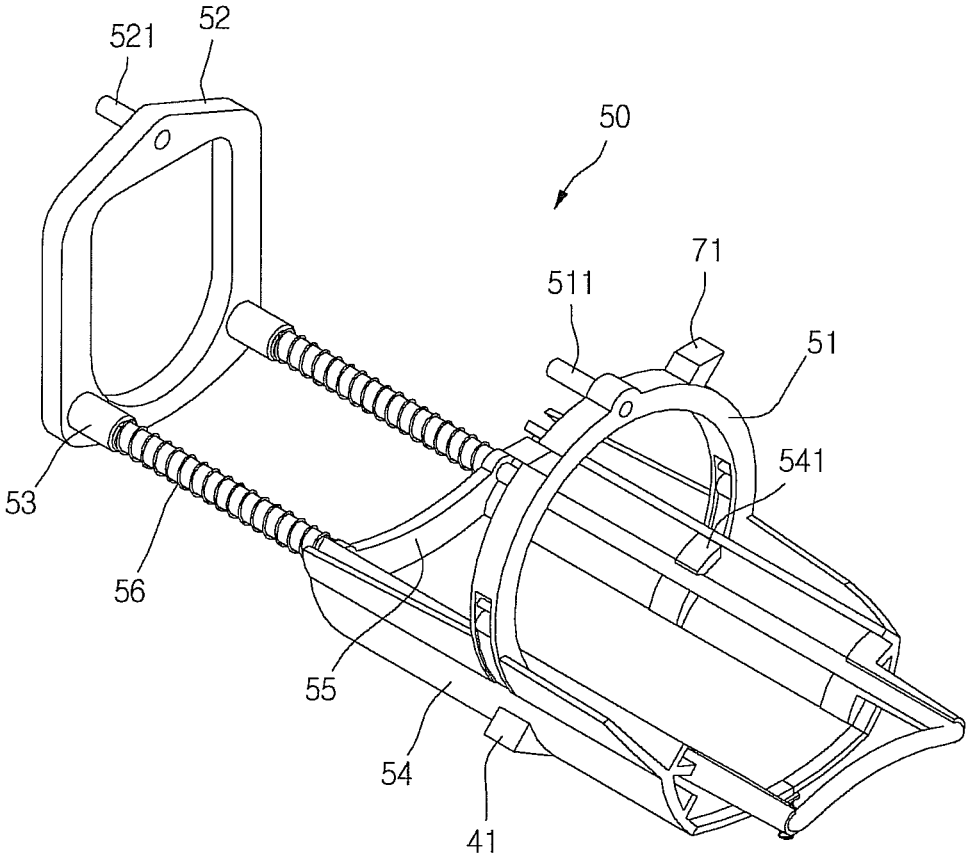
FIG. 7 is a perspective view of an agitating assembly according to an embodiment of the present invention.

FIG. 7 is a perspective view of an agitating assembly according to an embodiment of the present invention.

Referring to FIG. 7, the agitating assembly 50, one of the components of the cooling device 10 according to an embodiment of the present invention, includes a container seat 53 where a drink container is mounted, a first supporter 51 extending from substantially the center of the container seat 53, and a second supporter 52 extending upward from the rear end of the container seat 53.

In detail, a can drink or a wine drink can be mounted on the container seat 53. The present embodiment exemplifies that a pair of bars is arranged in parallel so that the cold air supplied through the intake grill 23 hits against the surface of a drink container as much as possible. The gap between the pair of bars is set smaller than the diameter of the drink container to be mounted so that the drink container comes in sufficient contact with the cold air without dropping through the space between the pair of bars.

The first supporter 51 may be arched from the container seat 53, in detail, the pair of bars so that a drink container can be inserted inside the arch. The first supporter 51 may extend directly from the container seat 53 or may be directly combined with the drink seat 53, and as shown in the figure, it may be combined with the drink seat 53, together with an air guide 54 as one unit.

The air guide 54 may be rounded along outer shape of a drink container in order to allow the high-pressure cold air discharged through the intake grill 23 to hit against the surface of the drink container in the container seat 53 as much as possible. The high-pressure cold air discharged through the air holes of the intake grill 23 disperses outward after hitting against the drink container, in which the cold air flows along the inner side of the air guide 54, such that the contact area and time of the cold air with the drink container increase. Therefore, heat can be rapidly exchanged between the cold air and the drink.

A first shaft 511, the center of swing of the agitating assembly 50, protrudes rearward at the top of the first supporter 51. The agitating assembly 50 swings with the first shaft 511 as the center of swing. The first shaft 511 is inserted through the supporter frame 26. In contrast, a shaft protruding from the supporter frame 26 may be formed and a hole that receives the shaft may be formed at the top of the first supporter 51.

The second supporter 52 may be arched, similar to the first supporter 51, or may be formed in a polygon, as shown in the figure. A second shaft 521, the same as the first shaft 511, also protrudes at the top of the second supporter 52. The first shaft 511 and the second shaft 521 are arranged in the same line and make the central axis of the swing of the agitating assembly 50. The second shaft 521 is fitted rotatably in the agitating assembly supporting portion 204 at the rear of the case 20. Since the second shaft 521 is a protruding part, the agitating assembly supporting portion 204 may be a hole that receives the second shaft 521. In contrast, a hole may be formed at the second supporter 52 and the agitating assembly supporting portion 204 may be a protruding part to be inserted in the hole.

Driven members 41, which are components of the driving assembly 40, are mounted at the left and right sides, respectively, on the underside of the agitating assembly 50. Stoppers 71, which are components of an anti-interference mechanism 70, are mounted at the left and right sides on the top of the first supporter 51. The driving assembly 40 and the anti-interference mechanism 70 are described hereafter in detail with reference to the drawings.

Figure 8:
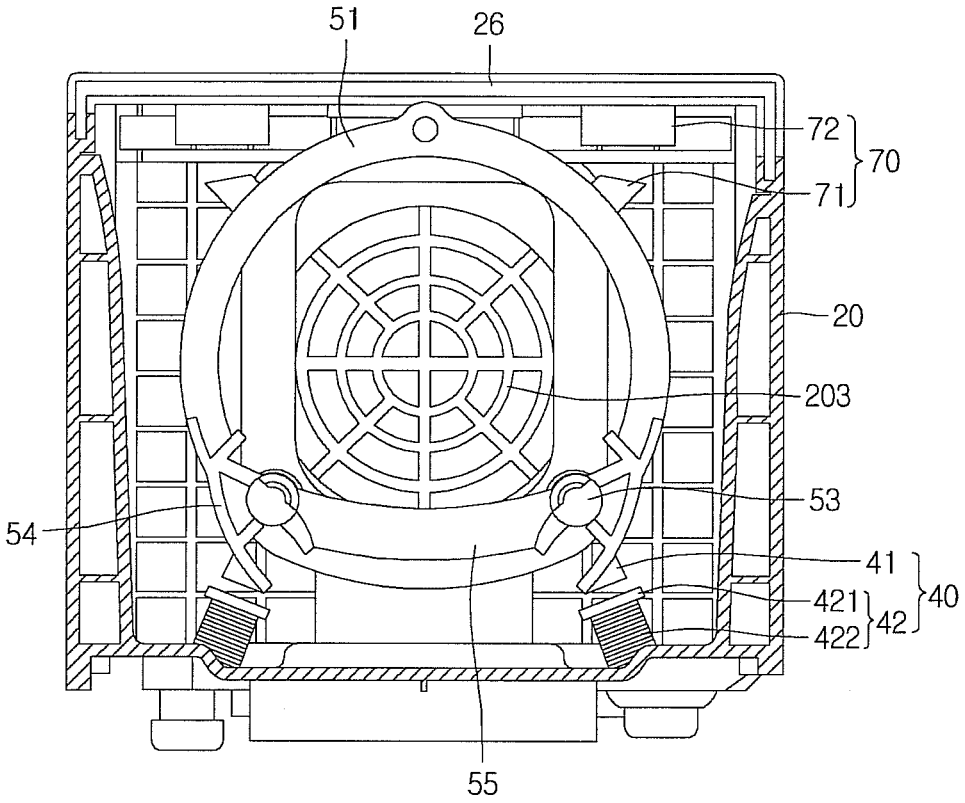
FIG. 8 is a front view showing the mounting status of a driving assembly and an anti-interference mechanism of the cooling device according to an embodiment of the present invention.

FIG. 8 is a front view showing the mounting status of a driving assembly and an anti-interference mechanism of the cooling device according to an embodiment of the present invention.

Referring to FIG. 8, the agitating assembly 50 is equipped with the driving assembly 40 that induces the swing of the agitating assembly 50.

In detail, the driving assembly 40 includes the driven members 41 at the left and right sides, respectively, on the underside of the agitating assembly 50 and driving units 42 mounted on the bottom of the case 20, at a position corresponding to the driven members 41. The driven members 41 may be permanent magnets. The driving units 42 each include a core 421 fixed to the bottom of the case 20 and a coil 422 wound around the core 421.

The operation of the driving assembly 40 is described.

First, when electricity is applied to the coil 422, the driving unit 42 becomes an electromagnet and magnetic flux is generated inside the core 421. An attractive force or a repulsive force is generated between the driving unit 42 and the driven member 41 by the magnetic flux. Accordingly, by changing the flow direction of the current such that an attractive force is applied to the driving unit 42 while the driven member 41 comes close to the driving unit 4 and a repulsive force is applied from when the driven member 41 comes closest to the driving unit 42, the agitating assembly 50 swings. The agitating assembly 50 requires starting torque in order to starts swinging from the stop status. That is, when a force that pushes up the agitating assembly 50 a little to the left or the right is applied from the outside, the agitating assembly 50 can swing with much ease. A method of giving the starting torque will be described below with reference to the drawings.

The swing angle of the agitating assembly 50 is changed by the weight of a drink to be seated in the agitating assembly 50 or the design tolerance generated in the process of manufacturing the product etc. For example, the larger the weight of a drink, the larger the inertia of the agitating assembly 50 would become and the larger the swing angle would become. As the swing angle of the agitating assembly 50 increases, the outer side of the first supporter 51 interferes with the inner side of the case 20, such that vibration and noise may be generated, or stiffening failure may be generated in the agitating assembly 50 or the case 20. In order to prevent the problems, it is preferable to mount the anti-interference mechanism 70 in order to keep the agitating assembly 50 at a predetermined distance from the sides of the case 20 irrespective of the weight of a drink or the design tolerance.

In detail, the anti-interference mechanism 70 includes the stoppers 71 mounted on the agitating assembly 50 and shock-absorbing members 72 mounted on the case 20. It is preferable that the stoppers 71 are mounted on the outer side of the agitating assembly 50, and for example, they may be mounted at the left and right sides of the first supporter 51, respectively. The stopper 71 may be positioned at a predetermined distance upward from the plane that vertically bisects the first supporter 51. The shock-absorbing members 72 may be mounted on the top inside the case 20, at predetermined positions that the stoppers 71 can reach while the agitating assembly 50 swings.

According to this structure, when the agitating assembly 50 swings over a predetermined angle, the stoppers 71 can reach the shock-absorbing members 72 and the shock-absorbing members 72 absorb the impact energy of the stoppers 71. Further, the swing angle of the agitating assembly 50 can be limited.

It is preferable that any one or both of the stopper 71 and the shock-absorbing member 72 is made of a shock-absorbable material such as synthetic rubber (EPDM rubber) and silicon. In particular, it is preferable that the shock-absorbing member 72 is made of a shock-absorbable material.

Figure 9:
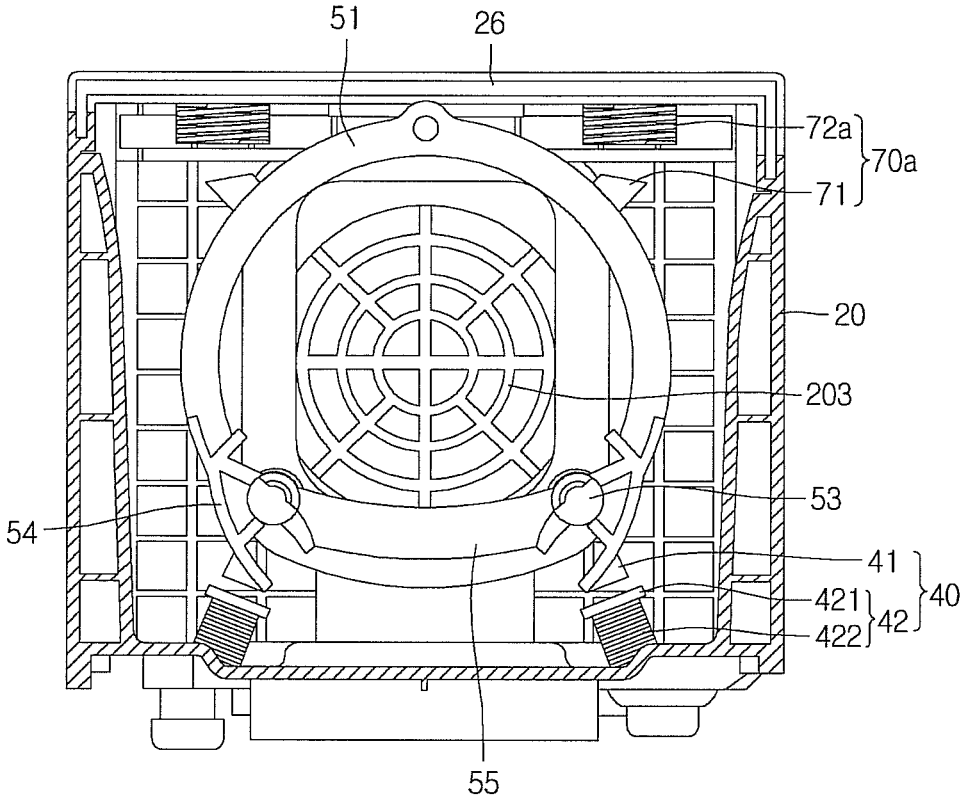
FIG. 9 is a front view showing the internal structure of a cooling device equipped with an anti-interference mechanism according to another embodiment of the present invention.

FIG. 9 is a front view showing the internal structure of a cooling device equipped with an anti-interference mechanism according to another embodiment of the present invention.

Referring to FIG. 9, though the present embodiment is substantially the same as the configuration of the embodiment shown in FIG. 8, it has a little difference in the structure of an anti-interference mechanism 70*a*.

In detail, the anti-interference mechanism 70*a* of the present embodiment includes the stoppers 71 and shock-absorbing members 72*a*, which are springs. The shock-absorbing member 72*a* may be just a spring having a predetermined elastic force and mounted on the top inside the case 20 or a plate may be attached to the lower end of the spring. The plate on the lower end of the spring, which is a part that the stopper 71 hits against, functions such that the kinetic energy transmitted from the stopper 71 is uniformly transmitted to the spring.

In detail, since the shock-absorbing member 72*a* is implemented by a spring, the energy transmitted by the stopper 71 while the agitating assembly 50 swings is accumulated as elastic energy of the spring. Therefore, the shock-absorbing member can also have the function of pushing and swinging the agitating assembly 50 by transmitting the restoring force back to the stopper 71. As a result, it is possible to achieve the effect of increasing the performance of swinging of the agitating assembly 50, in addition to the shock-absorbing effect.

Figure 10:
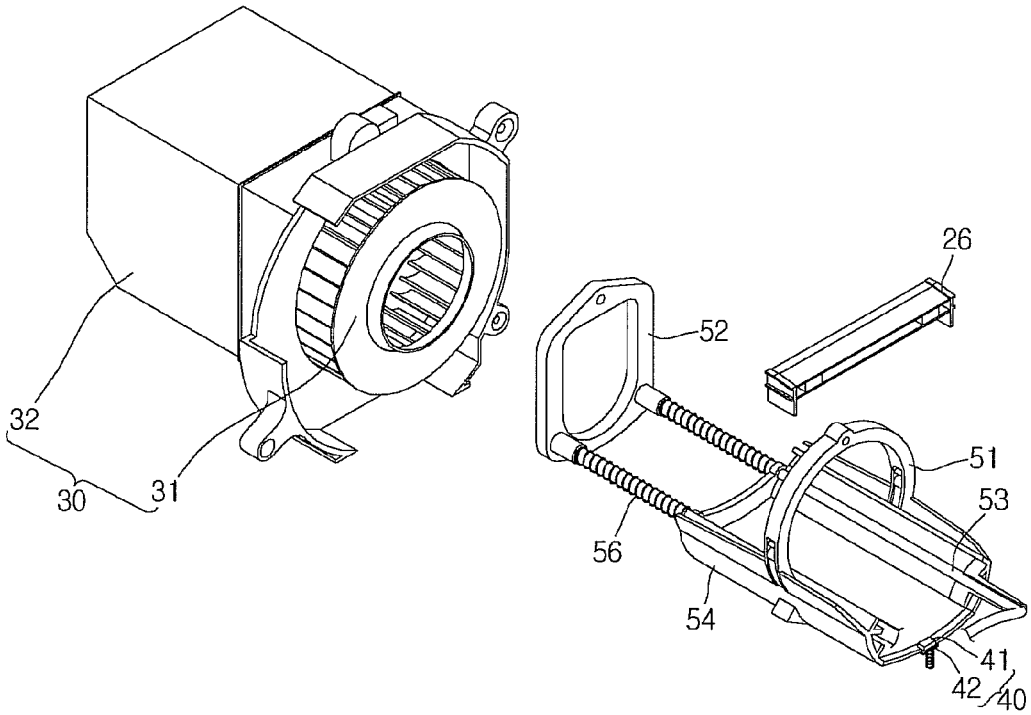
FIG. 10 is a perspective view of an agitating assembly having a driving assembly according to another embodiment of the present invention.

FIG. 10 is a perspective view of an agitating assembly having a driving assembly according to another embodiment of the present invention.

Referring to FIG. 10, the present embodiment is characterized in that the driving assembly 40 is disposed at the center of the underside of the front end of the agitating assembly 50. Obviously, the driving assembly 40 may be disposed at the center of the underside of the rear end of the agitating assembly 50 and may be disposed at the center of the underside of any portion between the front end and the rear end of the agitating assembly 50.

As another way, the driving assembly 40 may be disposed at the left and right sides on the underside of the agitating assembly 50, at the rear end of the agitating assembly 50.

Figure 11:
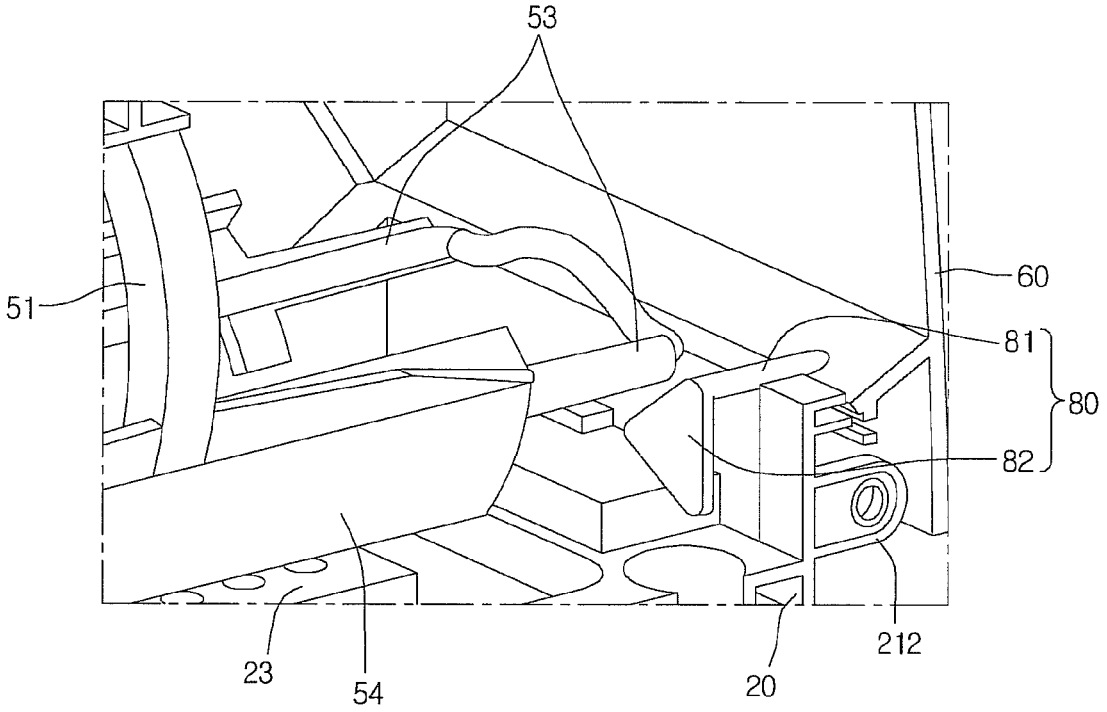
FIG. 11 is a partial perspective view showing a starting force supply mechanism of the agitating assembly in the cooling device according to an embodiment of the present invention.

FIG. 11 is a partial perspective view showing a starting force supply mechanism of the agitating assembly in the cooling device according to an embodiment of the present invention.

Referring to FIG. 11, the starting torque of the agitating assembly 50 is necessarily larger than the torque that is required while the agitating assembly 50 swings. That is, a relatively large force is required to make the agitating assembly 50 stopped with a drink container seated start swinging by pushing the agitating assembly 50 to the left or right. Further, once the agitating assembly 50 stars moving, the swing is easily maintained even if a relatively small force is applied, by the inertial force due to the weight of the drink container and the agitating assembly 50.

When the driving assembly 40 is composed of a permanent magnet and an electromagnet, the amount of current supplied to the electromagnet rapidly increases at the early stage, and then slowly decreases and is maintained at a predetermined level. Accordingly, a starting force supply mechanism that can reduce the amount of current for generating the starting torque is required.

For example, as shown in FIG. 11, a starting torque supply mechanism 80 may be mounted on the cover 60 of the cooling device 10 so that the force from a human which is taken to open or close the cover 60 is used as a power source that starts the agitating assembly 50.

In detail, the starting torque supply mechanism 80 includes an extension 81 extending to a predetermined distance from the inner side of the cover 60 and a trigger 82 formed at the end of the extension 81.

In more detail, the trigger 82 is convexly rounded at one side or formed in a triangle and extends in the direction crossing the extension 81.

The lower end of the trigger 82 of the starting torque supply mechanism 80 pushes a side of the agitating assembly 50 while the cover 60 closes, such that it provide starting torque for swinging the agitating assembly 50. In detail, the lower end of the trigger 82 presses a side of the agitating assembly 50, that is, the container seat 53 while the cover 60 closes, thereby providing a swing force to the agitating assembly 50.

On the other hand, while the cover 60 opens, the agitating assembly 50 keeps stopped and the trigger 82 rotates about the extension 81, moving over the side of the agitating assembly 50, that is, a side of the container seat 53. The trigger 82 can rotate back to the initial position upon separating from the agitating assembly 50. To this end, an elastic member such as a torsion spring may be connected to the extension 81.

As described above, the force from a user which is applied to close the cover acts as starting torque for swinging the agitating assembly 50, there is the advantage that specific electric energy for starting the agitating assembly 50 is not needed.

Figure 12:
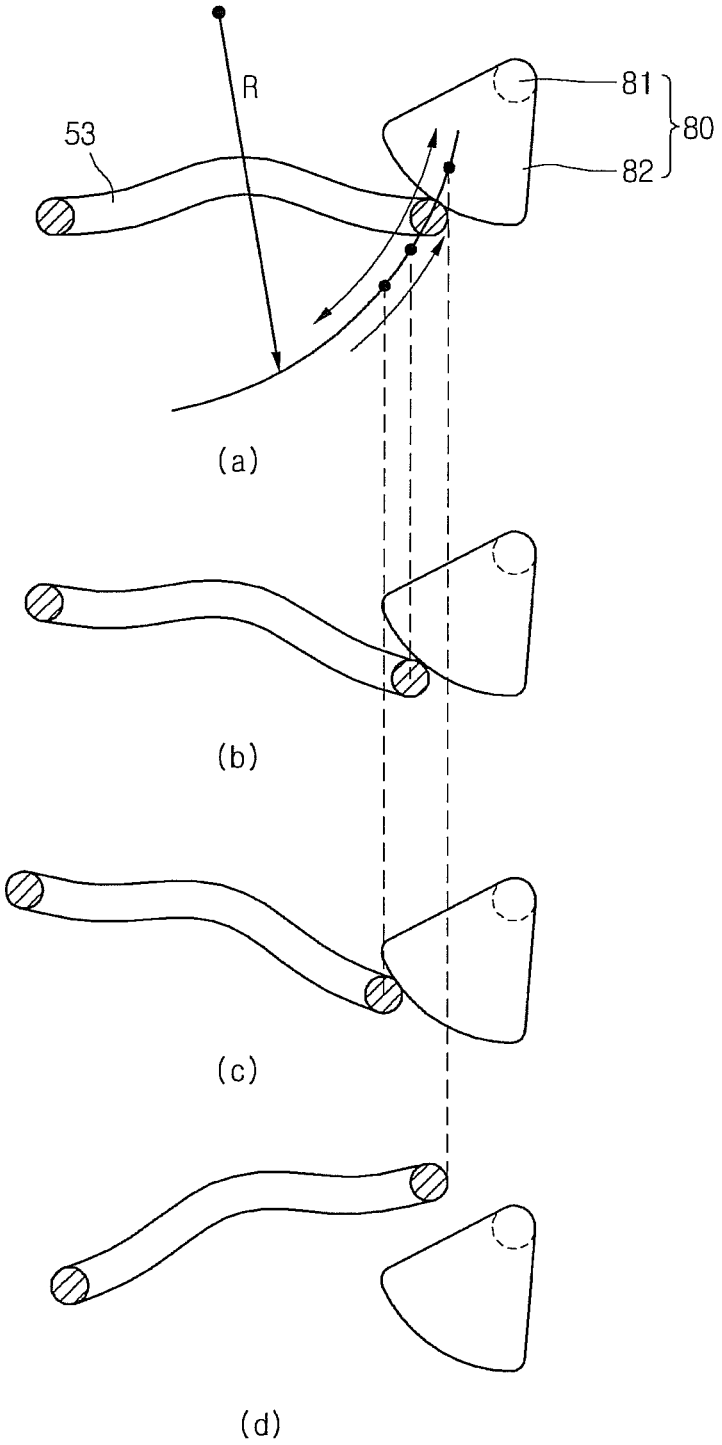
FIG. 12 is an operation view schematically showing a process of applying starting torque to the agitating assembly by means of a starting torque supply mechanism according to an embodiment of the present invention.

FIG. 12 is an operation view schematically showing a process of applying starting torque to the agitating assembly by means of a starting torque supply mechanism according to an embodiment of the present invention.

Referring to (a) to (d) of FIG. 12, as the cover 60 is turned and covered, the starting torque supply mechanism 80 correspondingly turns and the trigger 82 of the starting torque supply mechanism 80 comes closer to a side of the container seat 53 of the agitating assembly 50.

As the cover 60 is closed, the lower end of the trigger 82 presses the side of the container seat 53, and by the pressing force, the container seat 53 turns with a radius of curvature R. When the cover 60 is fully closed, the trigger 82 is separated from the container seat 53 and the container seat 53 starts swinging by returning to the initial position by inertia. A current is supplied to the driving assembly 40 in this status and the swinging is continued.

A clockwise turning force keeps applied to the trigger 82 by the torsion spring connected to the extension 81 of the starting torque supply mechanism 80. That is, when the trigger 82 is turned counterclockwise and then the force is removed, it turns back clockwise and returns to the initial position. Further, since the trigger 82 presses the container seat 53 and receives a clockwise reaction force while the cover 60 closes, the trigger 82 presses the container seat 53, keeping the initial position.

How the trigger 82 operates while the cover 60 opens after a rapid freezing mode is described hereafter.

Figure 13:
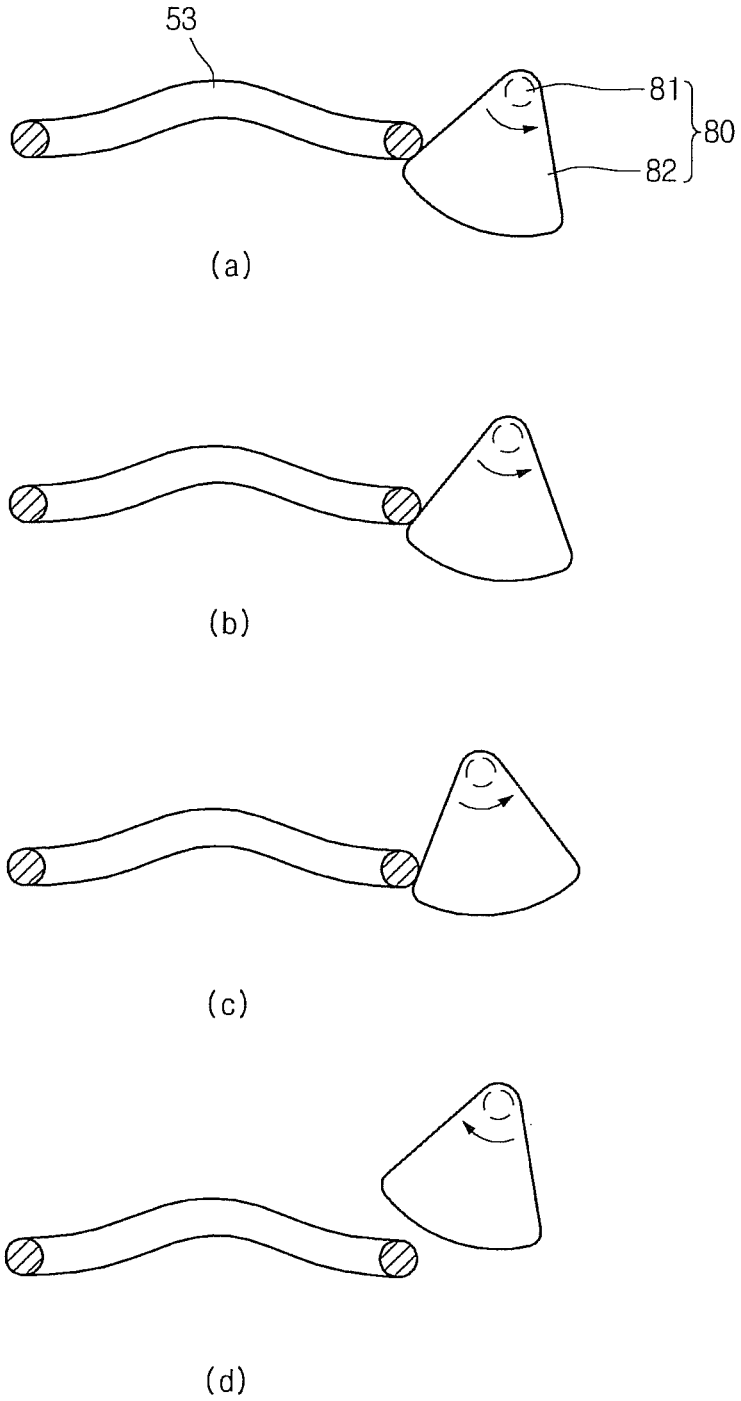
FIG. 13 is a view showing the operation of the starting torque supply mechanism while the cover of the cooling device according to the present invention opens.

FIG. 13 is a view showing the operation of the starting torque supply mechanism while the cover of the cooling device according to the present invention opens.

Referring to (a) to (d) of FIG. 13, the trigger 82 is under the container seat 52, when the cover 62 is fully closed. As the cover 60 opens, the trigger 82 comes in contact with the underside of a side of the container seat 53. Then, the trigger 82 is turned counterclockwise and raised up in contact with the agitating assembly 50 by the weigh of the container seat 53 and the drink container. Upon separating from the container seat 53, the trigger 82 is turned clockwise and returned to the initial position by the restoring force of the torsion spring connected to the extension 81. In this configuration, the elastic force of the torsion spring is smaller than the weight of the container in the container seat 53, such that the container seat 53 keeps stopped without being turned by the trigger 82 while the cover 60 opens.

Figure 14:
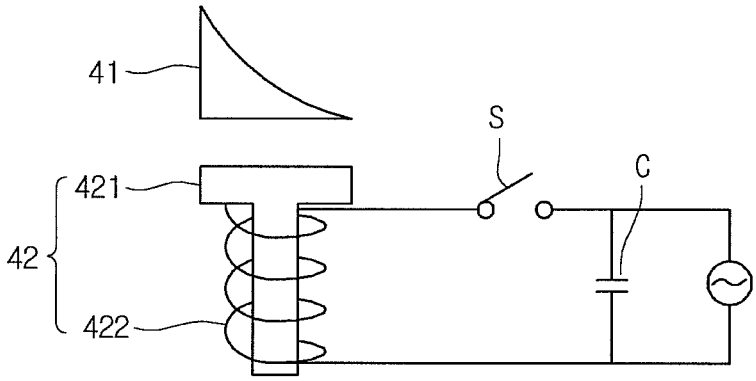
FIG. 14 is a circuit diagram showing a starting force supply mechanism of an agitating assembly according to another embodiment of the present invention.

FIG. 14 is a circuit diagram showing a starting force supply mechanism of an agitating assembly according to another embodiment of the present invention.

Referring to FIG. 14, it is one of the characteristics of the present invention to apply starting torque by changing the current supplied to the driving units 42 of the driving assembly 40.

In detail, a switch S that connects or disconnects power and a charging condenser C are provided in the driving circuit of the driving unit 42. Voltage is kept in the charging condenser C before the rapid freezing mode starts, and when the rapid freezing mode starts, the voltage in the charging condenser C is supplied to the coil 422 of the driving unit 42. Accordingly, a force enough to swing the stopped container seat 53 is generated, because the magnitude of the magnetic flux generated by the coil 421 is larger than that of the magnetic flux generated while the container seat 53 swings.

What is claimed is:

1. A refrigerator, comprising:

a body having a storage chamber;

a door selectively opening or closing the storage chamber;

a cooling device including:

a case of which a front surface is open and mounted at a side in the storage chamber;

an agitating assembly that is swingably disposed in the case;

a cover that is rotatably mounted on the case to open or close the front surface of the case; and a driving assembly that is mounted on the case and an underside of the agitating assembly to generates a driving force for swinging the agitating assembly;

a refrigeration cycle for producing cold air to be supplied to the storage chamber and the cooling device; and an anti-interference mechanism provided at the agitating assembly and the case to prevent the agitating assembly from hitting against an inner surface of the case while the agitating assembly swings, wherein the agitating assembly includes:

a container seat where a container is seated;

a first supporter upwardly extending from a predetermined position of the container seat and having a first shaft, the first shaft configured to protrude at a top of the first supporter;

a second supporter upwardly extending from a rear end of the container seat and having a second shaft, the second shaft configured to protrude at a top of the second supporter to be rotatably coupled to a rear surface of the case and aligned with the first shaft to define a swing axis of the agitating assembly; and a supporter frame mounted on a top surface of the case and to which the first shaft is rotatably coupled, wherein the driving assembly includes:

a pair of driving units mounted on left and right edge portions on a bottom surface of the case to alternately generate attractive force and repulsive force, each driving unit including:

a core fixed to the bottom surface of the case; and a coil wound around the core; and a pair of driven members corresponding to the pair of driving units respectively and disposed at left and right sides on the underside of the agitating assembly, the pair of driven members including permanent magnets, and wherein the anti-interference mechanism includes:

a pair of stoppers disposed at left and right sides of an outer surface of the first supporter; and a pair of shock-absorbing members corresponding to the pair of stoppers and disposed at left and right sides on the top surface of the case, wherein the pair of shock-absorbing members are configured to absorb impact energy by the pair of stoppers and limit a swing angle of the agitating assembly.

2. The refrigerator of claim 1, wherein at least one of the pair of stoppers and the pair of shock-absorbing members is synthetic rubber or is of a silicon material.

3. The refrigerator of claim 1, wherein at least the pair of shock-absorbing members is an elastic member including a spring.

4. The refrigerator of claim 1, wherein the container seat is a pair of bars arranged in parallel, and wherein the first supporter is arched from the container seat.

5. The refrigerator of claim 4, wherein the pair of stoppers is positioned at a predetermined distance upward from a horizontal plane which bisects the first supporter.

* * * * *